United States Patent [19]

Samuelson

[11] 4,385,886

[45] May 31, 1983

[54] SPINNERET PLATE

[75] Inventor: Harry V. Samuelson, Chadds Ford, Pa.

[73] Assignee: E. I. Du Pont de Nemours and Company, Wilmington, Del.

[21] Appl. No.: 341,333

[22] Filed: Jan. 21, 1982

[51] Int. Cl.[3] ..... A01J 21/00

[52] U.S. Cl. ..... 425/464; 264/177 F; 425/378 S

[58] Field of Search ..... 264/177 F; 428/397, 428/378 S, 464; 425/464

[56] References Cited

U.S. PATENT DOCUMENTS

| | | | |
|---|---|---|---|
| 3,419,936 | 1/1969 | Sims | 425/461 |
| 3,509,304 | 4/1970 | Moore | 319/69 R |
| 4,054,709 | 10/1977 | Belitsin et al. | 264/177 F |
| 4,245,001 | 1/1981 | Phillips | 428/224 |
| 4,316,924 | 2/1982 | Minemura et al. | 428/397 |

FOREIGN PATENT DOCUMENTS

| | | | |
|---|---|---|---|
| 145184 | 11/1980 | German Democratic Rep. | 264/177 F |
| 47-38449 | 9/1972 | Japan | 264/177 F |
| 47-38450 | 9/1972 | Japan | 264/177 F |
| 96359 | 7/1960 | Netherlands | 264/177 F |
| 891464 | 3/1958 | United Kingdom | 264/177 F |
| 837285 | 6/1960 | United Kingdom . | |
| 843179 | 8/1960 | United Kingdom . | |
| 853062 | 11/1960 | United Kingdom . | |

OTHER PUBLICATIONS

"Chart of Irregular Shaped Holes" by Kasen, Nozzle Mfg. Co., Osaka, Japan, 1 page 264–1772.

*Primary Examiner*—Jay H. Woo

[57] ABSTRACT

A spinneret plate the outlet orifice of which is made up of slots, at least two of the slots being arc shaped, useful to produce textile filaments that are readily fracturable in a fluid jet to produce a yarn having free ends.

9 Claims, 6 Drawing Figures

SPINNERET PLATE

BACKGROUND

This invention relates to a spinneret plate that may be used to produce by melt spinning a textile filament that may be combined with other such textile filaments to produce a yarn that may be readily fractured in a fluid jet to produce a yarn with free ends. The yarn with free ends may be made into fabric having a "natural" feel. The invention also relates to the textile filament made by use of the aforesaid spinneret plate.

Spinneret plates in which the outlet orifice is a shape other than circular are well known, see for example Moore U.S. Pat. No. 3,509,304, British Pat. No. 837,285 and British Pat. No. 853,062. It is also known to jet texture yarn to produce products having broken filaments and nodes and splayed sections, see for example Magel U.S. Pat. No. 4,100,725. "Fractured" yarns in which there are a number of continuous filaments that run the length of the yarn, and in which the continuous filaments have "wing" portions that are split off and fractured transversely are disclosed in Phillips U.S. Pat. No. 4,245,001.

SUMMARY OF THE INVENTION

The present invention is a spinneret that can be employed to produce textile filaments that may be fractured in a jet texturing process to produce a yarn that may be made into a fabric with a "natural" feel. The spinneret produces filaments that are splittable longitudinally and fracturable transversely, thus producing a yarn having numerous fine filaments and numerous free ends. Such a yarn is more fully disclosed and claimed in Wei U.S. patent application Ser. No. 285,023, filed July 20, 1981, now U.S. Pat. No. 4,364,998. The spinneret of the present invention is a type that can be used to make the yarn of the Wei application.

The spinneret of the present invention has two parallel planar surfaces and at least one capillary (usually many) extending through the plate from one planar surface to the other. The capillary has an inlet orifice and an outlet orifice. The term "capillary" means the aperture through the spinneret plate through which polymer passes during a spinning operation, and includes any counterbore. The outlet orifice comprises a plurality of interconnected slots, at least two of which are arc-shaped. Preferably, there are three to six arc-shaped slots. Each of the arc-shaped slots is coincident with the circumference of a circle having a radius $R_1$, and subtends an angle, measured at the center of the circle, of 120 to 270 degrees. The apexes of the angles of the arc-shaped slots lie on the circumference of a circle having a radius $R_2$, which is 1.1 to 6 times larger than $R_1$. The apexes of the arc-shaped slots are separated by at least the number of degrees equal to 270/N where N is the number of arc-shaped slots. The arc-shaped slots are positioned such that at least 90 degrees of the arc of each arc-shaped slot lies outside the circle defined by $R_2$. The area of the arc-shaped slots is at least 50% of the total area of the outlet orifice. Each arc-shaped slot is joined at only one end to at least one other arc-shaped slot by at least one slot that is located within the circle defined by $R_2$. The path of this joining slot does not cross the circle that would exist if the arc-shaped slot were extended. More than 82% of the area of the outlet orifice lies outside a central circle having a radius $\frac{1}{3}$ the radius of the smallest circle that, touching at least two points, circumscribes the outlet orifice. The radius of this circumscribing circle is hereinafter often referred to as $R_3$. $R_3$ is equal to or less than 0.5 cm. When there are only two arc-shaped slots their unjoined ends are wider than the width of the slot that is located within the circle defined by $R_2$, i.e., wider than the slot that connects the arc-shaped slots, and the unjoined ends of arc-shaped slots are pointed in the same rotational direction. The arc-shaped slots may be joined by straight slots that radiate from the center of the circular pattern, or the arc-shaped slots may be joined by a single curved slot that subtends an angle of no more than 260 degrees.

The outlet orifice of the spinneret plate of the invention may alternatively be made up of a plurality of outlet orifices that are in a closely spaced geometric pattern, the closely spaced geometric pattern being such that lines drawn to connect adjacent apertures would result in the same geometric pattern as described in the previous paragraph.

A preferred spinneret plate is one having the orifice configuration of FIG. 1.

The synthetic textile filament of the present invention is one made by spinning molten synthetic polymer through the spinneret plates described above. Such filaments are of course made of polymer of fiber forming molecular weight, and under conditions to substantially preserve the spun cross-sectional shape. The filaments of the invention have a deviation coefficient of at least 1.5.

The Figures show some of the outlet orifices of the spinneret of the present invention.

DETAILED DESCRIPTION

Figure 1:
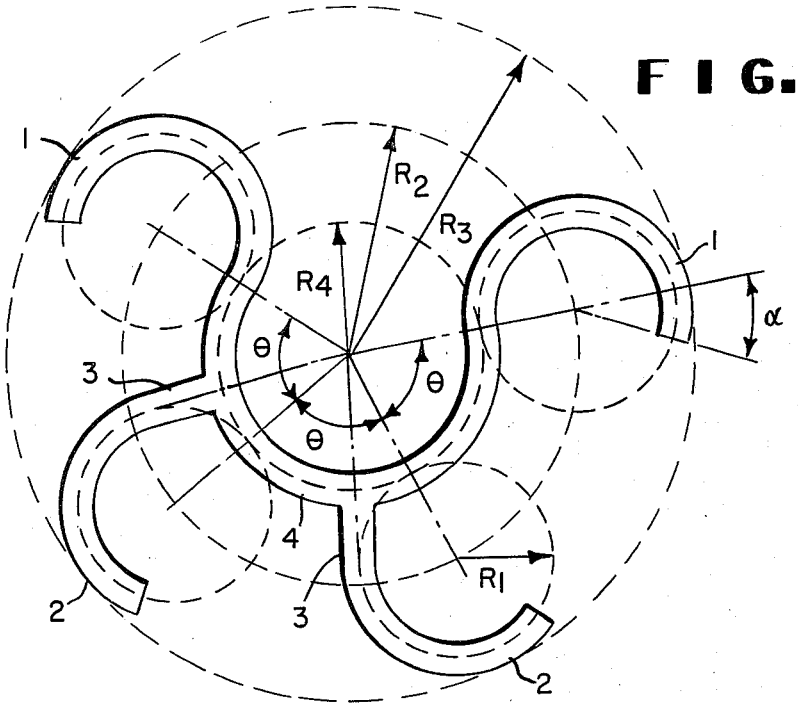
FIG. 1 is an outlet orifice having four arc-shaped slots that are connected by a single curved slot.

FIG. 1 illustrates a spinneret outlet orifice of the spinneret plate of the present invention. In FIG. 1 there are four arc-shaped slots, two are designated 1, and two are designated 2. Arc shaped slots 1 have a longer arcuate path than arc-shaped slots 2, but all slots subtend angles of 120 to 270 degrees. Arc shaped slots 1 subtend an angle of about 215 degrees, and arc-shaped slots 2 subtend an angle of about 135 degrees. Arcuate slots 2 are joined to other arcuate slots by means of straight slots 3, and curved slot 4. The arc-shaped slots 1 and 2 are coincident with the circumference of a circle having a radius $R_1$. The apexes of the angles of the arc-shaped slots 1 and 2 are located in a circular pattern, and the circular pattern has a radius $R_2$ that is 1.1 to 6 times larger than $R_1$. The apexes of the angles of the arc-shaped slots 1 and 2 are separated by the number of degrees $\theta$ at least equal to 270/N where N is the number of arc-shaped slots. [In FIG. 1, $\theta$ is about 75 degrees.] At least 90 degrees of each of the arc-shaped slots 1 and 2 lie outside the circle defined by $R_2$. The area of the arc-shaped slots 1 and 2 is at least 50% of the total area of the slots of the outlet orifice. The arc-shaped slots 1 are joined at only one end to at least one other arc-shaped slot by slots 4 and 3, and arc-shaped slots 2 are joined at one end to slots 3 and 4 to at least one other arc-shaped slot, and slots 3 and 4 are within the circle defined by $R_2$, and do not cross the circle that would exist if arcs 1 and 2 were extended. More than 82% of the area of slots lies outside a central circle having a radius $\frac{1}{3}$ of $R_3$, $R_3$ being the radius of smallest circle than can be drawn that, touching at least 2 points, circumscribes the outlet orifice. Angle $\alpha$ measures the number of degrees of arc that the unjoined end of the arc-shaped slot extends beyond the point of intersection of the arc and a straight line having as its two determinative points the center of the outlet orifice (i.e., the origin of radius $R_3$) and the apex of the angle of the arc (i.e., the origin of radius $R_1$). In the spinneret outlet orifice of FIG. 1, angle $\alpha$ is 35 degrees.

Figure 2:
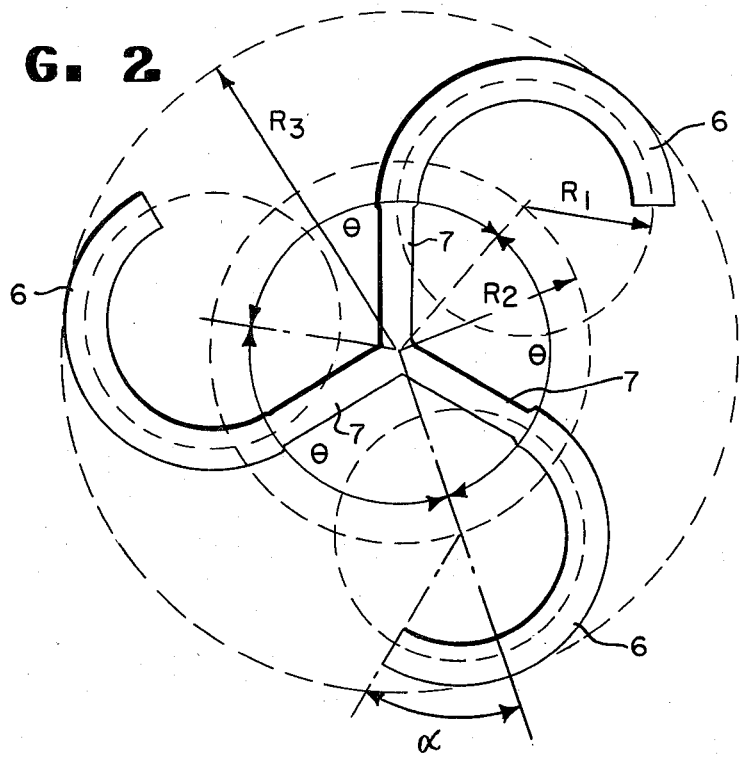
FIG. 2 is an outlet orifice having 3 arc-shaped slots that are connected by straight slots which radiate from the center of the orifice.

FIG. 2 also illustrates a spinneret outlet orifice of a spinneret plate of the present invention. In the embodiment of FIG. 2 there are 3 arc-shaped slots 6, each of which subtend an angle of about 180 degrees. The arc-shaped slots are connected to each other by straight slots 7 which radiate from the center of the outlet orifice. The apexes of the angles of arc-shaped slots 6 are located on the circumference of a circle having a radius $R_2$ which is 1.1 to 6 times greater than the radius $R_1$ of the arc-shaped slots 6. About 84% of the area of the slots lie outside a central circle having a radius $\frac{1}{3}$ of $R_3$. In the spinneret outlet orifice of FIG. 2 angle $\alpha$ is 49 degrees.

Figure 3:
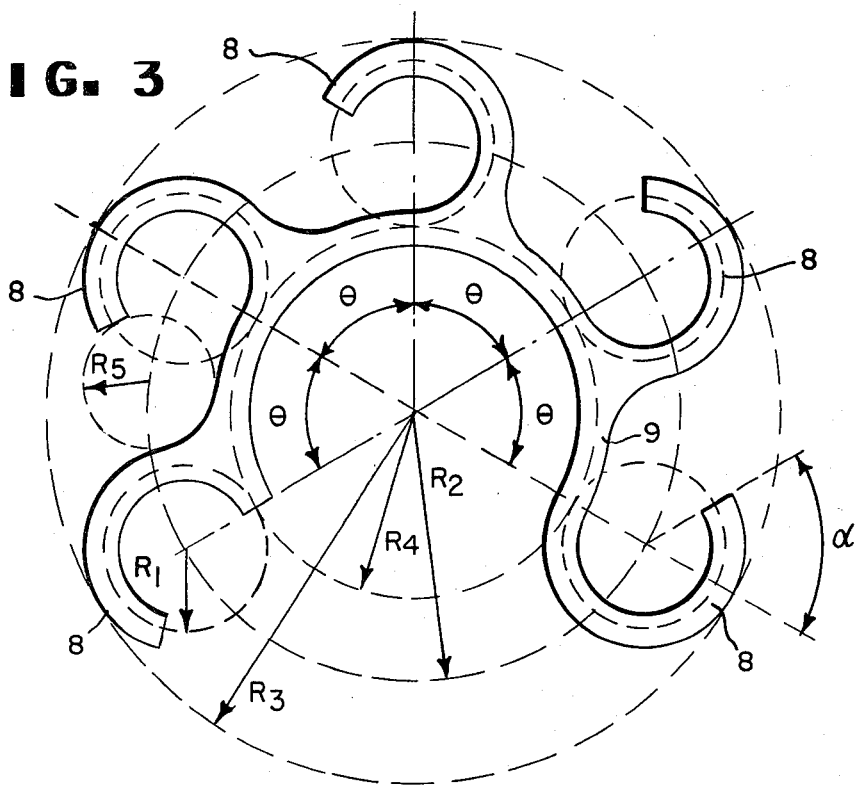
FIG. 3 is an outlet orifice having 5 arc-shaped slots that are connected by a single curved slot.

FIG. 3 is another illustration of the spinneret outlet orifice of the present invention. In the embodiment of FIG. 3 there are five arc-shaped slots 8 connected to a single curved slot 9 having a radius $R_4$. Each of the arc-shaped slots 8 subtend an angle of at least 120 degrees. The apexes of the angles of the arc-shaped slots 8 are located on the circumference of a circle having a radius $R_2$ which is 1.1 to 6 times the radius $R_1$ of the arc-shaped slots 8. 100% of the area of the slots lies outside a central circle having a radius $\frac{1}{3}$ of $R_3$. In the spinneret outlet orifice of FIG. 3, angle $\alpha$ is 63 degrees. In FIG. 3, the junction line of four of arcs 8 and the single curved slot that connects the arcs 8 is curved and has a radius of curvature $R_5$.

Figure 4:
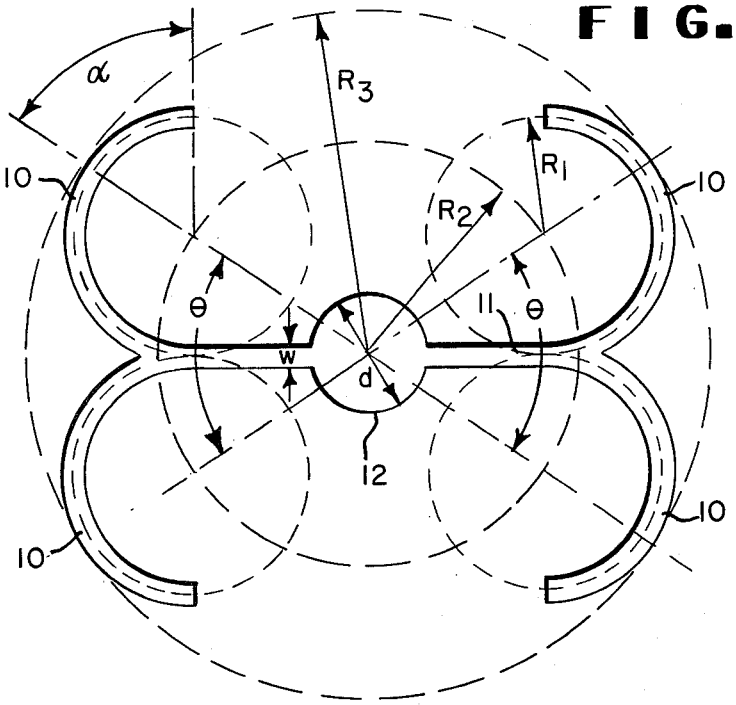
FIG. 4 is an outlet orifice having 4 arc-shaped slots connected to the ends of a straight slot having an enlarged circular center.

FIG. 4 illustrates still another spinneret outlet orifice of the present invention. In the embodiment of FIG. 4 there are four arc-shaped slots 10, connected as two pairs of two arcs of opposite rotational direction to the ends of a straight slot 11 of width w crossing the center of the orifice and enlarged at the center 12 by a circular hole of diameter d. The arcs have the same width as the straight slot. The arc-shaped slots are coincident with the circumference of circles of radius $R_1$, the centers of which lie in turn upon the circumference of a circle of radius $R_2$, which is 1.1 to 6 times greater than $R_1$. Angle $\theta$ is the angle formed by the radii of length $R_2$ joining the centers of the circles of radius $R_1$ for either pair of arcs of opposite rotational direction. Angle $\alpha$ measures the number of degrees of arc that the unjoined end of the arc-shaped slot extends beyond the point of intersection with a straight line having as its two determinative points the center of the outlet orifice and the geometric center of the arc. A spinneret outlet orifice of the present invention having the configuration shown in FIG. 4 has the following dimensions:

$R_1$=0.055 cm (0.02165 in)
$R_2$=0.0965 cm (0.038 in)
$R_3$=0.155 cm (0.061 in)
w=0.0084 cm (0.0033 in)
d=0.0254 cm (0.010 in)
$\alpha$=55.3°
$\theta$=69.5°

In the spinneret outlet orifice so constructed, 84% of the area of the outlet orifice lay outside a central circle having a radius of $\frac{1}{3}$ of the radius of the smallest circle that touching at least two points circumscribes the outlet orifice, i.e., $\frac{1}{3}$ of $R_3$, and 77% of the area of the outlet orifice is in the arcs 10.

Figure 5:
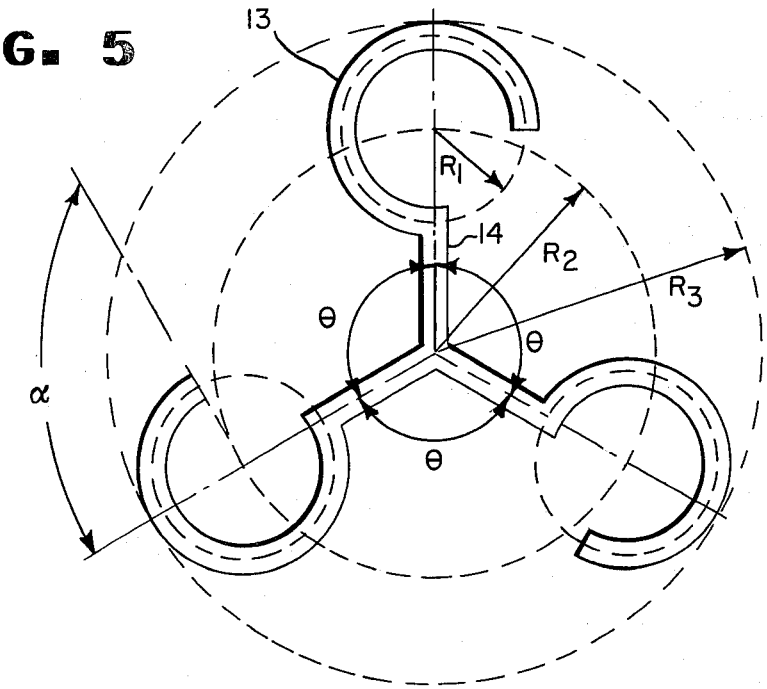
FIGS. 5–6 illustrate alternative spinneret outlet apertures of the invention.

FIG. 5 illustrates a spinneret outlet orifice of the present invention in which there are 3 arc-shaped slots 13 connected to each other by straight slots 14 which radiate from the center of the outlet orifice. The arcs have the same width as the straight slot. The arc-shaped slots are coincident with the circumference of circles of radius $R_1$, the geometric centers of which are located upon the extended center lines of the straight slots and also upon a circle of radius $R_2$, which is 1.1 to 6 times greater than $R_1$. The geometric centers of the arc-shaped slots are spaced at angle $\theta$ from each other. Angle $\alpha$ measures the number of degrees of arc that the unjoined end of the arc-shaped slot extends beyond the point of intersection with a straight line having as its two determinative points the center of the outlet orifice and the geometric center of the arc. A spinneret outlet orifice of the present invention having the configuration shown in FIG. 4 had the following dimensions:

$R_1$=0.033 cm (0.013 in)
$R_2$=0.076 cm (0.030 in)
$R_3$=0.114 cm (0.045 in)
w=0.0084 cm (0.0033 in)
$\alpha$=90°
$\theta$=120°

In the spinneret outlet orifice so constructed, 84% of the area of the outlet orifice lay outside a central circle having a radius of $\frac{1}{3}$ of $R_3$, and 84 percent of the area of the outlet orifice is in arcs 13.

Figure 6:
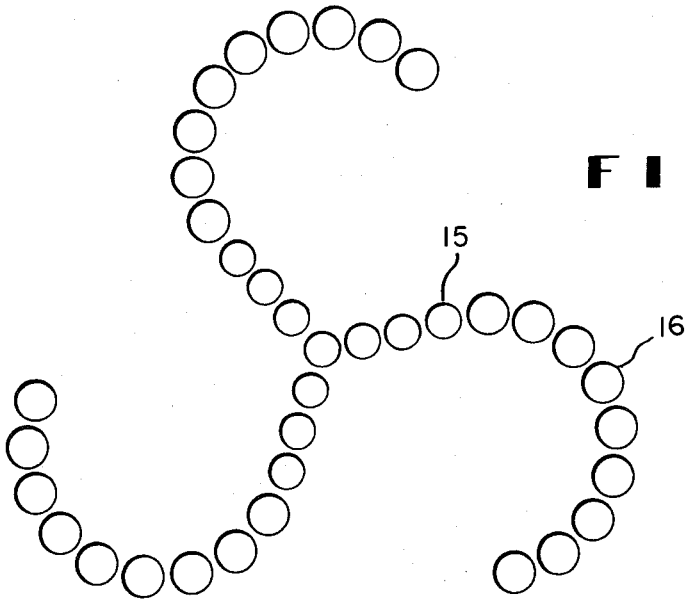

FIG. 6 is an alternative spinneret outlet orifice in which there are no arc-shaped slots, but instead a series of closely spaced orifices 15 and 16 in the pattern of the spinneret outlet orifice of FIG. 2. Orifices 16 are slightly larger than orifices 15. The outlet orifices are arranged so that lines drawn to connect adjacent apertures would result in the same geometric pattern as the plurality of interconnected slots of FIG. 2. A similar arrangement of apertures could of course in effect duplicate the outlet orifices shown in the other figures. When polymer is spun from this type of outlet orifice the individual streams unite (coalesce) to form a filament that is from a utilitarian point of view indistinguishable from one made with arc-shaped slots.

The spinneret outlet orifices do not have to be arcs that follow the circumference of a circle in order to achieve the desired filament cross section, for example, a group of interconnected rectangles arranged in a pattern approximating an arc-shaped aperture will work satisfactorily.

The spinnerets of this invention are primarily useful to make yarns that are to be subsequently processed to fracture the individual filaments and produce a yarn with free ends. A suitable method for measuring the number of free ends obtained by the subsequent processing is the shadowgraph test. It is run as follows:

A sample of yarn about 35 cm (14 in) long is cut from the test yarn. The yarn is placed longitudinally along the centerline of a clear plastic straight edge marked off in 1 cm segments. With the yarn positioned so that it is lying straight but not under tension, both ends of the yarn are taped to the straight edge, after which the yarn is covered by placing a second clear plastic straight edge over the first one, with the two straight edges in alignment. The yarn is viewed on a shadowgraph (e.g., Wilder Varibeam, Optometric Tools, Inc., Rockleigh, NJ, 07647 or Nippon Kogaku K.K., Japan, Model 6) at 20X magnification, and the measurements are made on the screen on which the yarn image is projected. Through 30 cm (12 in) of yarn length, the number of free ends in each 1 cm segment is counted and recorded.

The following calculation is made from the data obtained:

$$\text{Free ends/cm} = \frac{\text{Number of free ends counted in 30 cm}}{30}$$

Polyester is one of the preferred materials that may be processed in the spinneret of the invention. When a polyester is employed, its relative viscosity may be reported as "HRV" (acronym for Hexafluoroisopropanol Relative Viscosity) and it is determined as described by Lee in U.S. Pat. No. 4,059,949, column 5, line 65 to column 6, line 6.

Other conventional physical test methods are employed for determination of linear density, tenacity, and elongation of the yarns. Lea Product and skein breaking tenacity are measures of the average strength of a textile yarn and are determined in accordance with ASTM procedure D1578 (published 1979) using standard 80-turn skeins.

Fabric pilling propensities are evaluated on the "Random Tumble Pilling Tester" described by E. M. Baird, L. C. Legere, and H. E. Stanley in Textile Research Journal, vol. 26, pages 731–735 (1956). The following scale of pill level ratings is employed in evaluating fabrics in this test:

5.0—no pilling
4.0—slight pilling
3.0'—moderate pilling
2.0—heavy pilling
1.0—severe pilling Intermediate ratings within the above values are assigned to the nearest 0.1 unit to place fabrics in their proper rank in the above scale. Three samples of each fabric are rated. The ratings are averaged.

EXAMPLES

In the examples set forth below, the spinneret orifices are formed so that the radii and angles identified in the figures have the following values:

| Example<br>FIG. | I<br>1 | II<br>2 | III<br>3 |
|---|---|---|---|
| $R_1$ | 0.0305 cm<br>(0.0120 in) | 0.03366 cm<br>(0.01325 in) | 0.0191 cm<br>(0.0075 in) |
| $R_2$ | 0.0711 cm<br>(0.0280 in) | 0.0508 cm<br>(0.0200 in) | 0.0610 cm<br>(0.0240 in) |
| $R_3$ | 0.0914 cm<br>(0.036 in) | 0.0889 cm<br>(0.035 in) | 0.0838 cm<br>(0.033 in) |
| $R_4$ | 0.0413 cm<br>(0.01625 in) | — | 0.0419 cm<br>(0.0165 in) |
| $R_5$ | — | — | 0.0152 cm<br>(0.0060 in) |
| $\alpha$ | 35° | 49° | 63° |
| $\theta$ | 75° | 120° | 60° |

In the examples the deviation coefficient (D.C.) values for the filaments is defined as: the quotient of the perimeter of a given filament cross section or orifice and the perimeter of a circle having the same cross-sectional area of the given filament or orifice. Stated mathematically, $$D.C. = \frac{P}{2\sqrt{\pi A}} = \frac{P}{3.54\sqrt{A}}$$

wherein P is the actual perimeter of a given filament or orifice cross section and A is the actual area of such section, P and A being measured in consistent units. Hence, D.C. is a measure of the deviation of the cross section of a filament from a circular filament of equal denier or of the deviation of the cross section of an orifice from a circular hole of equal area. See Sims U.S. Pat. No. 3,419,936.

EXAMPLE I

Poly(ethylene terephthalate), having an HRV of about 23 and containing 0.3 wt. % $TiO_2$ as a delusterant, was spun at a spinneret temperature of 265° C. from a 34-hole spinneret in which 17 holes and the configuration shown in FIG. 1 and the other 17 had the mirror image configuration. In each hole the central arc was a slot 0.0089 cm (0.0035 in) wide having its inner edge sweeping through 225° of a circle having a radius of 0.037 cm (0.0145 in), while the outer arcs were slots 0.010 cm (0.004 in) wide with the inner (shortest) edge of each slot being on a circle having a radius of 0.025 cm (0.010 in). The total area of each outlet orifice was 0.00541 $cm^2$, and the total area of the arc-shaped slots 1 and 2 for each outlet orifice was 0.00392 $cm^2$. One hundred percent of the area of the outlet orifice lay outside a central circle having a radius ⅓ of $R_3$, and 72% of the area of the outlet orifice was in the arcs. Cross-flow quenching air was passed across the extruded filaments in such a way that it first contacted each filament between the middle two outer arcs. The filaments were gathered by guides into a yarn (hereafter designated as "Feed Yarn A"), passed to a roll operating at a peripheral speed of 3000 mpm (3281 ypm), and wound up on a package at 2923 mpm (3197 ypm). The deviation coefficient of "Feed Yarn A" was measured and found to be 1.9.

The feed yarn was passed from its windup package at a peripheral speed of 176 mpm (192 ypm) over a 1-meter (1.1-yd) long hot plate maintained at 180° C. to a draw roll operated at a peripheral speed of 300 mpm (328 ypm) and thence through a jet device and wound up under constant tension as a package of yarn (hereafter designated as the "textured yarn") at a peripheral speed of 285 mpm (312 ypm). The jet device was like that shown in FIGS. 6 and 7 of U.S. Pat. No. 4,157,605 (reference characters in the remainder of this paragraph being to FIG. 7 of that patent), except that the cylindrical baffle 40' was omitted and the yarn was passed vertically downward upon leaving the venturi 58. The yarn needle exit 57 had an inside diameter of 0.102 cm (0.040 in), and at its narrowest point the diameter of the exit passage of venturi 58 was 0.178 cm (0.070 in). The jet device was supplied with air at 1379 kPa (200 psi). The yarn needle was initially advanced to the fully closed position and was then backed off until the cross-sectional area of the annular restriction B was about equal to the cross-sectional area at its narrowest point of the exit passage of venturi 58; the cross-sectional area of orifice 72 being substantially larger than that of annular restriction B.

The textured yarn so produced was a soft, supple, spunlike yarn. It has a linear density of 11.6 tex (104.5 denier), a tenacity of 0.173 N/tex (1.96 gpd), an elongation of 5.6%, and a skein strength of 0.106 N/tex (Lea Product of 2256). The spunlike textured yarn was found to have 39 free ends per cm.

A 28-cut interlock circular fabric was knitted from the textured yarn, feeding it at 826 cm (325 in) per revolution with a 3-needle delay ("Fouquet 28 Cut SMHH" 2640-needle double knit machine, manufactured by Fouquetwerk—Franz u. Planck, Rottenburg/Neckar, Germany). The knitted fabric was scoured, dyed at 121° C. in a pressure beck for one hour, dried at 121° C. for 30 seconds, and heat set at 171° C. for 60 seconds. The fabric was found to have 30-minute pill ratings of 3.2 and 3.7 on its face and back, respectively, and had a fabric weight of 143 g/m$^2$ (4.23 oz/yd$^2$).

EXAMPLE II

Poly(ethylene terephthalate), having an HRV of about 23 and containing 0.3 wt % $TiO_2$ as a delusterant, was spun at a spinneret temperature of 270° C. from a 34-hole spinneret in which 17 holes had the configuration shown in FIG. 2 and the other 17 had the mirror image configuration. In each hole the three intersecting straight-sided slots were 0.0089 cm (0.0035 in) wide and the three slots having curved arcs as sides were 0.01016 cm (0.004 in) wide. The total area of each outlet orifice was 0.00424 cm$^2$, and the total area of the arc-shaped slots 6 for each outlet orifice was 0.00322 cm$^2$. Eighty-four percent of the area of the outlet orifice lay outside a central circle having a radius $\frac{1}{3}$ of $R_3$, and 76% of the area of the outlet orifice was in the arcs. The curved-arc slots were joined to the straight-sided slots at a distance of 0.0381 cm (0.015 in) from the intersection point of the centerlines of the straight-sided slots. Cross-flow quenching air was passed across the extruded filaments, and the filaments were gathered by guides into a yarn (hereafter designed as "Feed Yarn B") and wound up a package at 3000 mpm (3281 ypm). It had a linear density of 19.8 tex (178 denier). The extruded filaments had a deviation coefficient of 2.05.

Feed Yarn B was passed from its windup package at a peripheral speed of 130 mpm (142 ypm) over a 1-meter (1.1-yd.) long hot plate maintained at 150° C. to a draw roll operated at a peripheral speed of 208 mpm (228 ypm), through the jet device of Example I, around a let-down roll operated at a peripheral speed of 197 mpm (216 ypm), and wound up at a tension of 9.5 g as a package of yarn (hereafter designated as Textured Yarn B) at a peripheral speed of 188 mpm (205 ypm). The jet device was supplied with air at 1103 kPa (160 psi).

Textured yarn B was a soft, supple, spunlike yarn having a skein strength of 0.0674 N/tex (Lea Product of 1434). For this yarn the average number of free ends per cm was determined to be 108 by actually counting the free ends in samples of the yarn under the stereomicroscope.

The above procedure was repeated for Feed Yarn B, except that the jet device and let-down roll were bypassed and the yarn was wound up at 202 mpm (221 ypm). This drawn but untextured yarn had a linear density of 13.8 tex (124 denier), a tenacity of 0.343 N/tex (3.89) gpd), an an elongation of 14.6%.

EXAMPLE III

Poly(ethylene terephthalate), having an HRV of about 23 and containing 0.3% $TiO_2$, was spun at a spinneret temperature of 277° C. from a 34-hole spinneret which had the configuration shown in FIG. 3. The total area of each outlet orifice was 0.00417 cm$^2$, and the total area of the arc-shaped slots 8 for each outlet orifice was 0.00235 cm$^2$. One hundred percent of the area of the outlet orifice lay outside a central circle having a radius of $\frac{1}{3}$ of $R_3$, and 56% of the area of the outlet orifice was in the arcs. In each hole the width of the slots was 0.0076 cm (0.003 in). Cross-flow quenching air was passed across the extruded filaments, and the filaments were gathered by guides into a yarn (hereafter designated as "Feed Yarn C") and wound up on a package at 3000 mpm (3281 ypm). It had a linear density of 19.2 tex (173 denier). The fiber had a deviation coefficient of 2.0.

Feed Yarn C was passed from its windup package at a peripheral speed of 129 mpm (141 ypm) over a 1-meter (1.1-yd.) long hot plate maintained at 150° C. to a draw roll operated at a peripheral speed of 207 mpm (226.5 ypm), through the jet device of Example I, around a let-down roll at 196 mpm (214 ypm), and wound up at a tension of 9 g as a package of yarn (hereafter designated as "Textured Yarn C") at a peripheral speed of 188 mpm (206 ypm). The jet device was supplied with air at 1103 kPa (160 psi).

Textured Yarn C was a soft, supple, spunlike yarn having a linear density of 13 tex (117 denier), a tenacity of 0.15 N/tex (1.7 gpd), an elongation of 7.0%, and a skein strength of 0.111 N/tex (Lea Product of 2366). Textured Yarn C was found to have 22 free ends per cm when viewed on a shadowgraph and 43 free ends per cm by counting the free ends under the stereomicroscope.

If desired the spinnerets of the invention may have other additional outlet orifices of different shapes than those described, for example where a yarn of higher strength is desired the spinneret plate could have circular outlet orifices as well as the interconnected slot variety. The filaments produced from the circular orifices will have greater stability in the fracturing jets, and thus give strength. Hexalobal, trilobal, keyhole and propeller shaped orifices will give similar results.

I claim:

1. A spinneret plate having two parallel planar surfaces and at least one capillary extending through the plate from one planar surface to the other, said capillary having an inlet orifice and an outlet orifice, said outlet orifice comprising a plurality of interconnected slots, at least two of said slots being arc-shaped slots, each of said at least two arc-shaped slots being coincident with the circumference of a circle having a radius $R_1$, each of said arc-shaped slots subtending an angle of 120 to 270 degrees, the apexes of the angles of the arcs of the at least two arc-shaped slots lying on the circumference of a circle having a radius $R_2$ which is 1.1 to 6 times larger than $R_1$, and said apexes being separated by at least the number of degrees equal to 270/N where N is the number of said at least two arc-shaped slots; at least 90 degrees of arc of each of said at least two arc-shaped slots lying outside the circle defined by $R_2$, the area of said at least two arc-shaped slots being at least 50% of the total area of the outlet orifice, each of said at least two arc-shaped slots being joined at only one end to at least one other of said at least two arc-shaped slots by at least one slot that is located within the circle defined by $R_2$, the path of said at least one other slot being such that it does not cross the circle that would exist if said arc-shaped slots were extended, more than 82% of the area of the outlet orifice being outside a central circle having a radius ⅓ the radius of the smallest circle that, touching at least two points, circumscribes the outlet orifice; and when there are only two arc-shaped slots their unjoined ends being wider than the width of the slot that is located within the circle defined by $R_2$ and their unjoined ends being pointed in the same rotational direction.

2. The spinneret plate of claim 1 in which the outlet orifice has 3 to 6 of said arc-shaped slots.

3. The spinneret plate of claim 1 in which the at least two slots are joined by straight slots that radiate from the center of the circular pattern.

4. The spinneret plate of claim 1 in which the at least two slots are connected to a single curved slot, said single curved slot subtending an angle no more than 260 degrees.

5. A spinneret plate having two parallel planar surfaces and at least one capillary extending through the plate from one planar surface to the other, said capillary having an inlet orifice and a plurality of outlet orifices, and outlet orifices being arranged in a closely spaced geometric pattern such that lines drawn to connect adjacent apertures would result in the same geometric pattern as the plurality of interconnected slots as described in claim 1.

6. The spinneret plate of claim 1 having an outlet orifice having the configuration of FIG. 1.

7. The spinneret plate of claim 1 having outlet orifices that are mirror images.

8. The spinneret plate of claim 1 in which there are other outlet orifices having shapes different from that described in claim 1.

9. A spinneret plate having an outlet orifice having the configuration of FIG. 6.

* * * * *